United States Patent [19]

Barthlome

[11] 3,937,215

[45] Feb. 10, 1976

[54] THERAPEUTIC HAND EXERCISER

[75] Inventor: Donald E. Barthlome, Hampton, Va.

[73] Assignee: The United States of America as represented by the United States National Aeronautics and Space Administration Office of General Counsel-Code GP, Washington, D.C.

[22] Filed: June 3, 1975

[21] Appl. No.: 583,487

[52] U.S. Cl. ..... 128/26; 128/DIG. 20

[51] Int. Cl.[2] ..... A61H 1/02

[58] Field of Search ..... 128/26, 25, DIG. 20, 77, 128/87

[56] References Cited

UNITED STATES PATENTS

| | | | |
|---|---|---|---|
| 3,020,908 | 2/1962 | Daniels et al. | 128/26 |
| 3,457,912 | 7/1969 | Clark et al. | 128/26 |
| 3,756,222 | 9/1973 | Ketchum | 128/26 |

*Primary Examiner*—John D. Yasko

*Attorney, Agent, or Firm*—Howard J. Osborn; Wallace J. Nelson; John R. Manning

[57] ABSTRACT

A cyclic therapeutic hand exerciser based on inflation and deflation of structural members, which alternately imparts a straightening and a bending motion to the fingers wherein as air pressure inflates a splint-like upper member the fingers are straightened and upon deflation of the splint-like member and inflation of a wrist pouch a flap is tightened pulling the fingertips down and curling the fingers in toward the palm.

11 Claims, 4 Drawing Figures

THERAPEUTIC HAND EXERCISER

ORIGIN OF THE INVENTION

This invention was made by an employee of the National Aeronautics and Space Administration and may be manufactured and used by or for the Government of the U.S. for Governmental purposes without the payment of any royalties thereon or therefor.

BACKGROUND OF THE INVENTION

This invention pertains generally to therapeutic exercise devices for incapacitated hands and more particularly to a pneumatically driven device for cyclic operation of the hand. While finger exercise devices have been generally available in the prior art, they have been limited to either extremely complex systems which could only be used in therapy facilities or they have had very limited and special application. U.S. Pat. No. 3,457,912 to M. L. Clark et al. typifies the complex system. That patent describes a pneumatically actuated system for extending and closing the fingers which uses inflation to extend the fingers but depends upon driven cords pulling the individual fingers of a glove to close the fingers. The resulting complexity is such that both the cost and appearance of the unit are too formidable to encourage the use of such a device by the patient alone.

The exercise system disclosed in U.S. Pat. No. 3,581,740 to Sherborne is at the other extreme in that while it furnishes an appealing and inexpensive design for use in the patient's home, the resulting therapy is limited to only the straightening of the fingers. No motion is imparted to the fingers to reclose them and repeat the exercise cycle.

It is an object of the present invention to provide a complete cyclic motion to the fingers whereby the fingers and nearby portions of the hand may be alternately extended and closed.

It is a further object of the present invention to impart such motions to the hand by lightweight, flexible means which will readily self-adapt to all shapes and sizes of hands.

It is still a further object of the invention to provide such exercise means which are easily donned and removed to prevent claustrophobic anxiety on the part of the patient.

A still further object of the invention is to provide means whereby the patient may himself regulate the action of the exerciser and may, if desirable, furnish the entire motive power for the exerciser by other exercise devices such as pumps operated by foot motion or clenching the other hand.

SUMMARY OF THE INVENTION

These and other objects may be obtained by the use of the invention herein described wherein the preferred embodiment imparts motion to the hand and fingers by the use of two essentially independent sections of the device. One section, a splint-like member, is an elongated air pouch attached to the upper portion of the hand and wrist. A quick-disconnect strap is used to attach one end to the wrist, while fingers are inserted into individual loops or a partial mitten on the underside of the member at the other end. Inflation of this upper pouch forms a straight structural member which gently moves the hand and fingers to an extended position.

The second section of the device imparts the closing motion to the hand, when the upper pouch is deflated after it has extended the fingers to whatever degree is desired. The second section is an elongated pouch strapped under the wrist, one end of which is essentially fitted into the cup of the hand and the other end of which, when inflated, runs back along the wrist pointing toward the forearm. Attached to the forearm end of this lower pouch is a flap which runs forward along the pouch, over the fingertips and back again over the splint-like pouch on top of the hand. The length of this flap is adjusted so that when the lower pouch is inflated and the upper pouch deflated the fingers are forced to curl toward the wrist. But when the lower pouch is deflated it folds forward giving enough extra length to the flap to prevent interference with the extending motion of the fingers.

The complete cyclic motion for exercising the fingers is thus available by alternately inflating and deflating the two pouches, each one being inflated only when the other is either deflated or being deflated. Moreover, the extent of the motion in each direction can be precisely regulated by the degree of inflation of the pouch controlling that direction of motion.

DESCRIPTION OF THE PREFERRED EMBODIMENT

Figure 1:
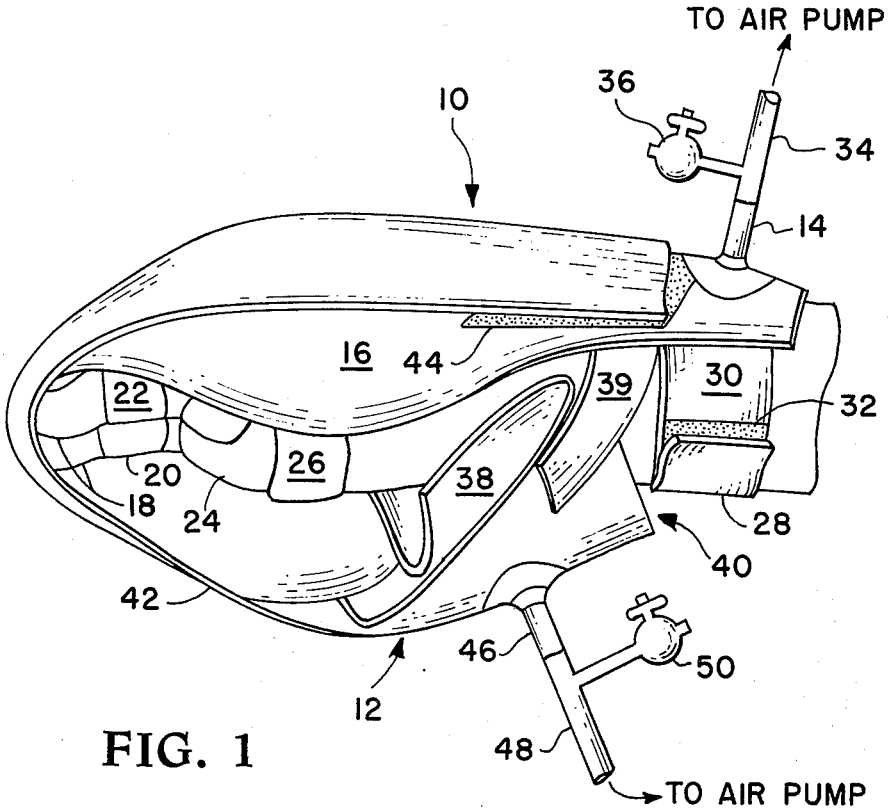
FIG. 1 is a side view of the invention shown on the hand and inflated to straighten the fingers.
Figure 3:
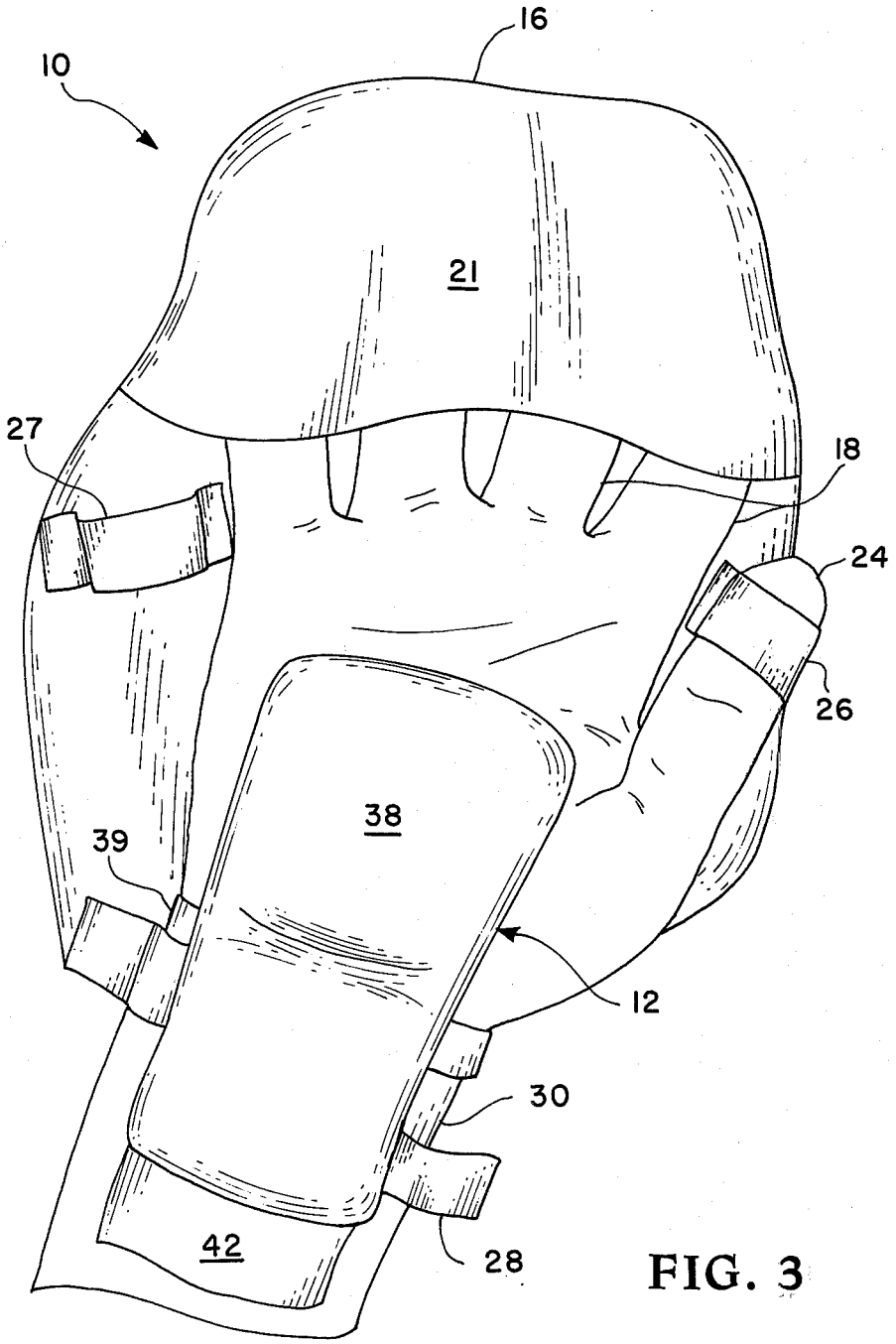
FIG. 3 is a plan view of an alternate embodiment of the invention with the flap only partially shown.

The preferred embodiment is shown in FIG. 1 as it appears when forcing the fingers to extend. In such a condition the upper section 10 is inflated and the lower section 12 is deflated. Upper section 10 is inflated through valve 14 which fills and makes rigid upper pouch 16. Upper pouch 16 is held on the upper surface of the hand by insertion of each finger 18 into loops 20 and 22 and other loops, not shown, insertion of thumb 24 into thumb loop 26, and by the use of wrist straps 28 and 30 which are held together in an adjustable, quickly removable manner by the use of bands 32 of nylon tape fabric available under the tradename "Velcro". A second thumb loop is available on the other side of the upper pouch to permit use on either the right or left hand, as seen in the embodiment of FIG. 3.

Stem 14 may be attached by tubing 34 to any suitable air pressure developing apparatus, such as an automatic cycling pump, or a continuous pump with cycling valve, or a manual pump. If a manual pump or foot pump is used it can yield the further advantage of exercise of another limb of the patient. Deflation of upper pouch 16 can also be performed either manually as by exit valve 36 or automatically at the pump.

While upper pouch 16 is inflated, lower pouch 38, held onto the wrist by strap 39, remains deflated and folded back upon itself at area 40. This considerably loosens flap 42 which runs over the tips of the fingers and lies flat on the top of upper pouch 16. Flap 42 is attached to the wrist end of upper pouch 16 by the use of Velcro bands 44 on the mating parts.

Bands 44 and bands 32 are used to perform the dual function of attachment and adjustability. Since any small area of the material Velcro will repeatably adhere to any other small area of the material until forcibly pulled apart, the adjustment can vary from a small overlapping area to full overlap and in fact beyond to a small overlap of the opposite ends of the areas. The length adjustment available is therefore approximately twice the length of the smaller of the two bands.

Figure 2:
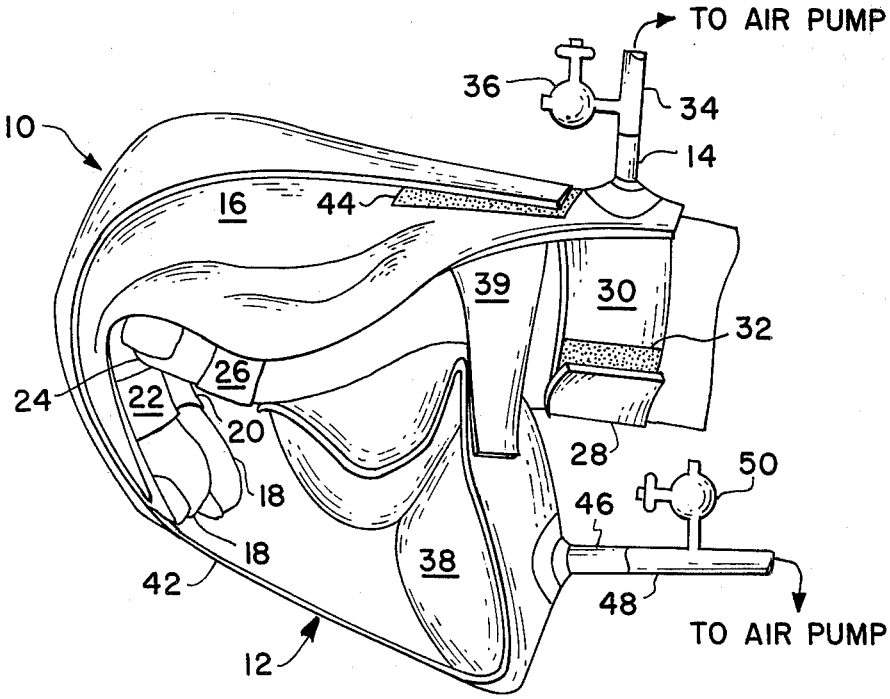
FIG. 2 is a side view of the invention shown on the hand and inflated to curl the fingers toward the wrist.

When upper pouch 16 is deflated by use of exit valve 36 and when lower pouch 38 is inflated through stem 46 and tubing 48 the configuration of the invention takes on the appearance of FIG. 2 and forces the hand to curl closed. Inflation forces lower pouch 38 to attempt to straighten out, and as it does so it tightens flap 42 around the fingertips causing them to bend. When the desired extend of bending has been reached lower pouch 38 is deflated, either by manual valve 50 or automatically further along on tubing 48.

FIG. 3 shows an alternative embodiment of the invention as viewed from the palm side of the hand, with flap 42 partially shown and being loose at the end which is otherwise wrapped over the fingertips. In this embodiment second thumb loop 27 is clearly shown in FIG. 3 along with first thumb loop 26 as previously described but the individual finger loops shown in FIG. 1 are replaced by partial mitten 21.

Figure 4:
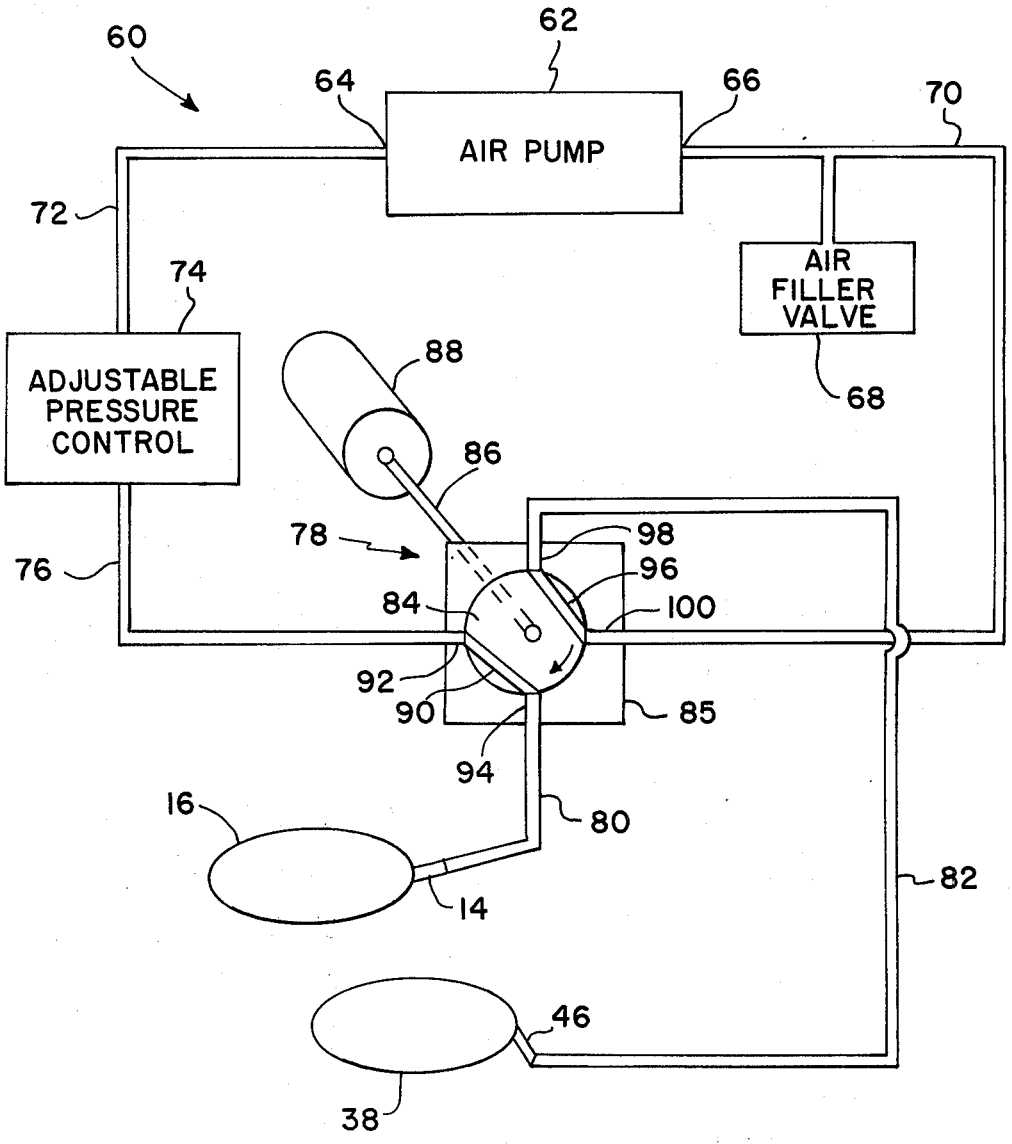
FIG. 4 is a schematic diagram in block form showing one system for cyclic inflation and deflation.

Any method of alternate inflation and deflation of upper section 10 and lower section 12 results in the alternate straightening and closing of the fingers, performing the desired therapy. FIG. 4 shows a schematic representation of such a system for alternate inflation and deflation. The pumping system generally designated by reference numeral 60 includes a motor driven pump 62 with a pressure side 64 and a vacuum side 66. Air filler valve 68 is connected to pump imput line 70 and automatically fills the system when the air pressure is too low in pumping system 60. Pump 62 pressurizes line 72 and adjustable pressure control 74 limits the resulting pressure in line 76 to whatever pressure desired to limit the motion to the fingers.

Cycling valve 78, shown in schematic form, operates to alternately inflate and deflate upper pouch 16 through stem 14 and line 80, while also inflating and deflating lower pouch 38 through stem 46 and line 82. This is accomplished by the valve center 84 being slowly rotated within valve body 85 in the direction of the indicating arrow by shaft 86 which is driven by motor 88. As shown in FIG. 4, passage 90 connects port 92 and port 94 which permits upper pouch 16 to be inflated and passage 96 connects port 98 and port 100 which permits lower pouch 38 to be deflated by the vacuum side of pump 66 through line 70. As previously described, this would cause the extension of the patient's fingers.

As valve center 84 rotates 90° passage 90 would then connect port 92 to port 98 and passage 96 would connect port 100 to port 94. Such connections then cause upper pouch 16 to deflate and lower pouch 38 to inflate, thus bending the patient's fingers. Each 90° rotation of valve center 84 thus reverses the action on the pouches and moves the patient's fingers in the opposite direction causing a continuous cycling exercise. The speed of the cycle is dependent upon the speed of motor 88, while the extent of motion is controlled by adjustable pressure control 74.

It is to be understood that the forms of the invention herein shown are merely preferred embodiments. Various changes may be made in shape, size or arrangement of parts; equivalent means may be substituted for those illustrated and described; and certain features may be used independently from other features without departing from the spirit and scope of the invention. For example, lower section 12 may be used independently of upper section 10 for patients who only experience difficulty in closing the hand and upper section may be used alone for patients who only need hand opening exercises.

What is claimed as new and desired to be secured by Letters Patent of the U.S. is:

1. A therapeutic hand exerciser comprising:

upper inflatable pouch means which when attached to the fingertips and arm of a disabled individual and inflated has sufficient rigidity to straighten the fingers of the individual, and when deflated is sufficiently pliable to permit the fingers to bend;

first inflation means attached to said upper inflatable pouch means and permitting inflation of said upper inflatable pouch means;

first deflation means attached to said first inflation means and permitting deflation of said upper inflatable pouch means;

fingertip attachment means connected to the underside of said upper inflatable pouch means suitable for holding the fingertips of the individual;

thumb attachment means connected to the underside of the upper inflatable pouch means suitable for holding the thumb of the individual;

arm attachment means connected to said upper inflatable pouch means at the end opposite from said fingertip attachement means and permitting attachment of said upper inflatable pouch means to the arm of said individual;

lower inflatable pouch means which when attached to the wrist of said individual and inflated extends from the palm of the hand of the individual to the wrist portion of the arm of the individual and when deflated is capable of folding such that both ends are approximately at the palm of the hand;

wrist attachment means attached to said lower inflatable pouch means and capable of holding said lower inflatable pouch means onto the wrist of said individual and allowing folding of said lower inflatable pouch means when deflated;

second inflation means attached to said lower inflatable pouch means and permitting inflation of said lower inflatable pouch means;

second deflation means attached to said second inflation means and permitting deflation of said lower inflatable pouch means;

flap means attached to and extending from the end of said lower inflatable pouch means nearest the wrist, with sufficient length for wrapping under the palm, around the extended fingertips, over the knuckles and to the top of the wrist;

flap attachment means attached to and anchoring one end of said flap means in the region of the top surface of the wrist; and flap length adjustment means attached to said flap means to yield a length which permits the fingers to be straightened when said lower inflatable pouch means is deflated and forces the fingers to bend when said lower inflatable pouch means is inflated.

2. A therapeutic hand exerciser as in claim 1 wherein said flap attachment means also functions as said flap length adjustment means.

3. A therapeutic hand exerciser as in claim 1 wherein said arm attachment means are adjustable for various sizes of arms of individuals.

4. A therapeutic hand exerciser as in claim 1 wherein said fingertip attachment means comprises loops into which the fingertips may be inserted and said thumb attachment means includes duplicate loops located to enable use of the exerciser on either the right hand or left hand.

5. A therapeutic hand exerciser as in claim 1 wherein said fingertip attachment means comprises a partial mitten into which the fingertips may be inserted.

6. A therapeutic hand exerciser as in claim 1 wherein said flap attachment means is attached to the top surface of said upper inflatable pouch means.

7. A therapeutic hand exerciser for forcing the hand of a disabled individual to close comprising:

lower inflatable pouch means which when attached to the wrist of said individual and inflated extends from the palm of the hand of said individual to the wrist portion of the arm of said individual and when deflated is capable of folding such that both ends are approximately at the palm of the hand;

wrist attachment means attached to said lower inflatable pouch means and capable of holding said lower inflatable pouch means onto the wrist of said individual and allowing folding of said inflatable pouch means when deflated;

inflation means attached to said lower inflatable pouch means and permitting inflation of said lower inflatable pouch means;

deflation means attached to said inflation means and permitting deflation of said lower inflatable pouch means;

flap means attached to and extending from the end of said lower inflatable pouch means nearest the wrist, with sufficient length for wrapping under the palm, around the extended fingertips, over the knuckles and to the top of the wrist;

flap attachment means attached to and anchoring one end of said flap means in the region of the top surface of the wrist; and flap length adjustment means attached to said flap means to yield a length which permits the fingers to be straightened when said lower inflatable pouch means is deflated and forces the fingers to bend when said lower inflatable pouch means is inflated.

8. A therapeutic hand exerciser as in claim 7 wherein said flap attachment means is attached to the top surface of said wrist attachment means.

9. A therapeutic hand exerciser as in claim 7 wherein said flap attachment means also functions as said flap length adjustment means.

10. A therapeutic hand exerciser as in claim 7 wherein said wrist attachment means is adjustable for various sizes of wrists of individuals.

11. A therapeutic hand exerciser comprising:

upper inflatable pouch means which when attached to the fingertips and arm of a disabled individual and inflated has sufficient rigidity to straighten the fingers of the individual, and when deflated is sufficiently pliable to permit the fingers to bend;

first inflation means attached to said upper inflatable pouch means and permitting inflation of said upper inflatable pouch means;

first deflation means attached to said first inflation means and permitting deflation of said upper inflatable pouch means;

fingertip attachment means connected to the underside of said upper inflatable pouch means suitable for holding the fingertips of the individual;

thumb attachment means connected to the underside of said upper inflatable pouch means suitable for holding the thumb of the individual;

arm attachment means connected to said upper inflatable pouch means at the end opposite from said fingertip attachment means and permitting attachment of said upper inflatable pouch means to the arm of the individual;

lower inflatable pouch means which when attached to the wrist of said individual and inflated extends from the palm of the hand of the individual to the wrist portion of the arm of the individual and when deflated is capable of folding such that both ends are approximately at the palm of the hand;

wrist attachment means attached to said lower inflatable pouch means and capable of holding said lower inflatable pouch means onto the wrist of said individual and allowing folding of said lower inflatable pouch means when deflated;

second inflation means attached to said lower inflatable pouch means and permitting inflation of said lower inflatable pouch means;

second deflation means attached to said second inflation means and permitting deflation of said lower inflatable pouch means;

flap means attached to and extending from the end of said lower inflatable pouch means nearest the wrist, with sufficient length for wrapping under the palm, around th extended fingertips, over the knuckles and to the top of the wrist;

flap attachment means attached to and anchoring one end of said flap means in the region of the top surface of the wrist;

flap length adjustment means attached to said flap means to yield a length which permits the fingers to be straightened when said lower inflatable pouch means is deflated and forces the fingers to bend when said lower inflatable pouch means is inflated;

pump means producing air pressure and quantity sufficient to inflate said upper inflatable pouch means and said lower inflatable pouch means, and containing a pressure outlet and a vacuum inlet;

adjustable pressure control means attached to the pressure outlet of said pump means controlling the air pressure to which said upper inflatable pouch means and said lower inflatable pouch means are subjected;

filler valve means attached to the vacuum inlet of said pump means assuring sufficient air quantity for said pump means;

cycling valve means attached to the vacuum inlet of said pump means, to said adjustable pressure control means, to said upper inflatable pouch means and to said lower inflatable pouch means, causing alternate inflating and deflating of each inflatable pouch means in such a manner that one inflatable pouch means is always being deflated while the other is being inflated; and drive means attached to said cycling valve means and providing the cycling action.

* * * * *